US007086250B2

(12) United States Patent
Ishihara et al.

(10) Patent No.: US 7,086,250 B2
(45) Date of Patent: Aug. 8, 2006

(54) OUTDOOR UNIT OF AIR CONDITIONER

(75) Inventors: Hiroki Ishihara, Sakai (JP); Hiromune Matsuoka, Sakai (JP); Toshiaki Mukaidani, Sakai (JP); Tadashi Saoi, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 238 days.

(21) Appl. No.: 10/493,862

(22) PCT Filed: Jun. 30, 2003

(86) PCT No.: PCT/JP03/08326

§ 371 (c)(1),
(2), (4) Date: Apr. 28, 2004

(87) PCT Pub. No.: WO2004/005805

PCT Pub. Date: Jan. 15, 2004

(65) Prior Publication Data

US 2005/0150247 A1 Jul. 14, 2005

(30) Foreign Application Priority Data

Jul. 4, 2002 (JP) ..... 2002-195535

(51) Int. Cl.
*F25B 39/04* (2006.01)

(52) U.S. Cl. ..... 62/508; 62/224; 62/498

(58) Field of Classification Search ..... 62/193, 62/224, 324.4, 498, 507, 508
See application file for complete search history.

(56) References Cited

U.S. PATENT DOCUMENTS

| | | | | |
|---|---|---|---|---|
| 6,094,925 | A * | 8/2000 | Arshansky et al. | 62/81 |
| 6,170,270 | B1 * | 1/2001 | Arshansky et al. | 62/81 |
| 6,185,953 | B1 * | 2/2001 | Sada et al. | 62/324.4 |
| 6,722,156 | B1 * | 4/2004 | Tanimoto et al. | 62/510 |

FOREIGN PATENT DOCUMENTS

| | | | |
|---|---|---|---|
| JP | 53-104463 | U | 1/1986 |
| JP | 02-106638 | A | 4/1990 |
| JP | 02-47677 | B2 | 10/1990 |
| JP | 04-22667 | U | 2/1992 |
| JP | 07-000816 | Y2 | 1/1995 |
| JP | 07-027372 | A | 1/1995 |
| JP | 11-230582 | A | 8/1999 |
| JP | 2001-311538 | A | 11/2001 |
| JP | 3241167 | B2 | 12/2001 |
| KR | 20 0134030 | | 5/1999 |

* cited by examiner

*Primary Examiner*—Melvin Jones
(74) *Attorney, Agent, or Firm*—Shinlyu Global IP Counselors

(57) ABSTRACT

An outdoor air conditioner unit is connected to indoor units by a gaseous refrigerant communication pipe and a liquid refrigerant communication pipe. The outdoor air conditioner unit is provided with a gas-side shut-off valve and a liquid-side shut-off valve. The gas-side shut-off valve has a pipe connecting port to which the gaseous refrigerant communication pipe is connected. The liquid-side shut-off valve has a pipe connecting port to which the liquid refrigerant communication pipe is connected. In a plan view, the pipe connecting ports are offset from each other in both the depthwise direction and the widthwise direction. Thus, the outdoor air conditioner unit is configured to reduce interference between the refrigerant pipes connected to the gas-side and liquid-side shut-off valves of the outdoor unit.

15 Claims, 7 Drawing Sheets

Fig. 7 (a) - (Prior Art)
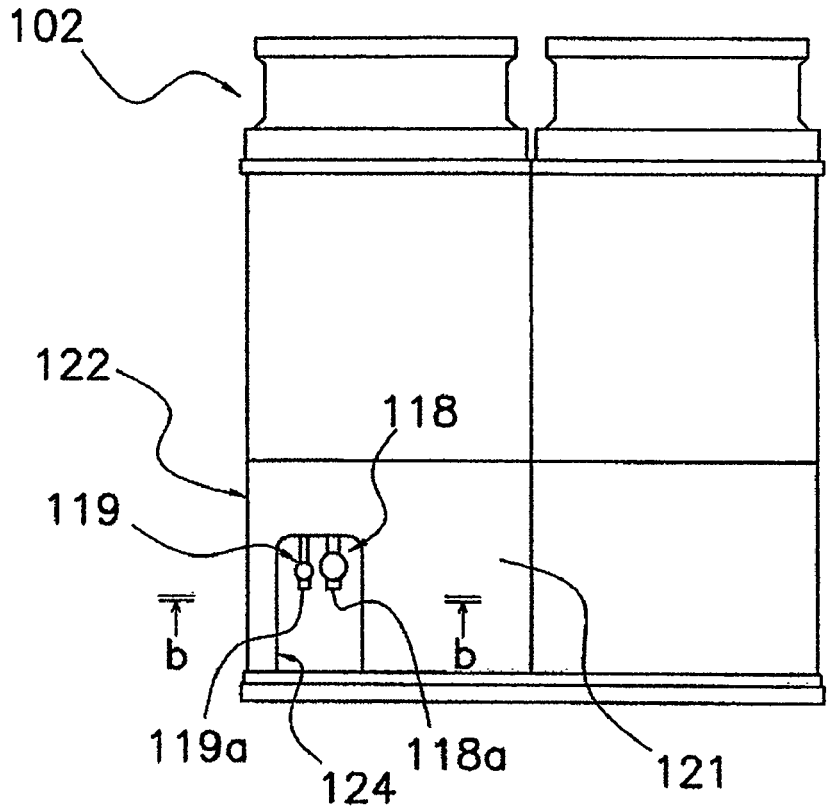
Fig. 7 (b) - (Prior Art)
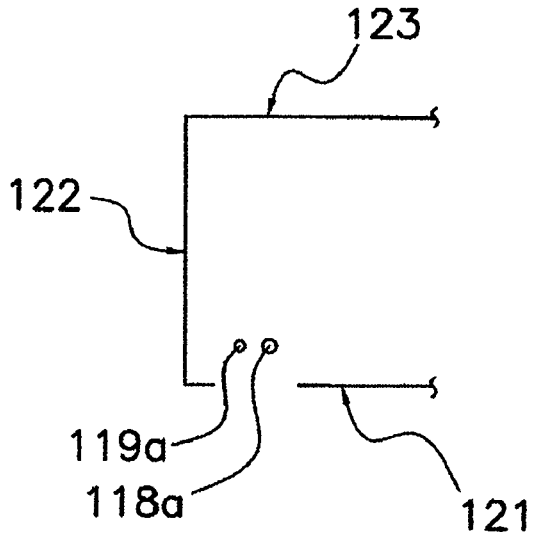

OUTDOOR UNIT OF AIR CONDITIONER

TECHNICAL FIELD

The present invention relates to an outdoor unit for an air conditioner. More specifically, the present invention relates to an outdoor air conditioner unit that is connected to indoor units by a gaseous refrigerant communication pipe and a liquid refrigerant communication pipe.

BACKGROUND ART

Among the air conditioning systems used in office buildings and residential buildings, split-type systems having an indoor unit and an outdoor unit connected by communication pipes are widely used. For example, in the multi-split type air conditioning system (multiple-indoor-unit split-type air conditioning system) used in office buildings, the outdoor unit is installed on the roof or other location and the indoor units are installed in the ceiling or other location of each floor, the outdoor unit and indoor units being connected together by a gaseous refrigerant pipe and a liquid refrigerant pipe to form a refrigerant circuit.

The outdoor unit of such an air conditioning system has a gas-side shut-off valve and a liquid-side shut-off valve at the terminal ends of the refrigerant circuit there-within. These shut-off valves are switched from the closed state to the open state after the outdoor unit and the indoor units have been installed onsite and the gaseous refrigerant pipe and liquid refrigerant pipe from the indoor units are connected. As a result, refrigerant can flow between the outdoor unit and the indoor units.

In a conventional air conditioning system, the gas-side shut-off valve 118 and the liquid-side shut-off valve 119 of the outdoor unit 102 are arranged side by side along the front panel 121 of the casing as shown in FIG. 7 or in front of and in rear of each other along the side panel 122 of the casing (not shown). Since the two shut-off valves 118, 119 are closely adjacent to each other, it is easier to complete the work of applying thermally insulating tape to the gaseous refrigerant pipe and liquid refrigerant pipe, which are connected to the pipe connecting ports 118*a*, 119*a* of the shut-off valves 118, 119 and drawn out of the outdoor unit, and the work of covering the valve area with a decorative metal plate.

When the pipe connecting ports of the gas-side shut-off valve and liquid-side shut-off valve are aligned along one panel of the casing as shown in FIG. 7, there is not a problem if the refrigerant pipes are drawn out of the outdoor unit in a direction perpendicular to said panel. However, if the pipes are drawn in a direction generally parallel to said panel, the pipes will interfere with each other unless they are drawn out at different heights. While the problem of interference is resolved by installing the gaseous refrigerant pipe and liquid refrigerant pipe at different heights, there are cases in which the two pipes cannot be installed at different heights due to space restrictions or other conditions related to the installation work. The surrounding conditions differ at each installation site and there is no guarantee that the conditions of a particular site will allow the pipes to be drawn out in a convenient direction.

In such situations, the gaseous refrigerant pipe and the liquid refrigerant pipe end up following a path that is bent more than would otherwise be necessary as a result of avoiding interference between the pipes. Consequently, the cost of installing the air conditioning system and the time required for installation both increase.

SUMMARY OF THE INVENTION

The object of the present invention is to reduce interference between the refrigerant pipes connected to the outdoor unit of an air conditioning system both in cases in which the refrigerant pipes are drawn out in a direction parallel to the depth dimension of the outdoor unit (hereinafter described as "the depthwise direction") and in cases in which the refrigerant pipes are drawn out in a direction parallel to the width dimension of the outdoor unit (hereinafter described as "the widthwise direction").

According to a first aspect of the invention, an outdoor air conditioner unit is connected to indoor units by a gaseous refrigerant communication pipe and a liquid refrigerant communication pipe and is provided with a gas-side shut-off valve and a liquid-side shut-off valve. The gas-side shut-off valve has a first connecting port to which the gaseous refrigerant communication pipe is connected. The liquid-side shut-off valve has a second connecting port to which the liquid refrigerant communication pipe is connected. In a plan view, the first connecting port and second connecting port are offset from each other in both the depthwise direction and the widthwise direction.

In conventional outdoor units, the first connecting port and second connecting port are aligned in either the depthwise direction or the widthwise direction. Consequently, when the connecting ports are aligned in the depthwise direction, the refrigerant communication pipes will interfere with each other if they are drawn out in the depthwise direction at the same height from the connecting ports. Meanwhile, when the connecting ports are aligned in the widthwise direction, the refrigerant communication pipes will interfere with each other if they are drawn out in the widthwise direction at the same height from the connecting ports.

Conversely, in an outdoor unit in accordance with the first aspect of the present invention, the first connecting port and second connecting port are offset from each other in both the depthwise direction and the widthwise direction in a plan view. Since the connecting ports are offset by a sufficient amount such that the refrigerant communication pipes do not interfere with each other in a plan view when they are drawn out from the connecting ports in the depthwise direction or in the widthwise direction, the refrigerant communication pipes will not interfere with each other in cases where the refrigerant communication pipes are drawn out at the same height in the depthwise direction or cases where the refrigerant communication pipes are drawn out at the same height in the widthwise direction.

Thus, an outdoor unit in accordance with this claim makes it possible to avoid interference between the refrigerant communication pipes connected to the shut-off valves both in cases where the refrigerant communication pipes are drawn out in the depthwise direction and in cases where the refrigerant communication pipes are drawn out in the widthwise direction.

According to a second aspect of the present invention, the outdoor air conditioner unit of the first aspect of the present invention is provided, wherein the first connecting port and the second connecting port face in the same direction.

Since both connecting ports face in the same direction, the refrigerant communication pipes drawn out from the connecting ports can be thermally insulated and covered more easily. Also, the refrigerant communication pipes connected to the shut-off valves can be installed without interfering with each other when they are drawn out in the depthwise direction or in the widthwise direction. As a result, the amount of curved portions of the refrigerant communication pipes can be held to a minimum.

According to a third aspect of the present invention, the air conditioner outdoor unit of the first or second aspects of the present invention is provided, wherein the first connecting port and second connecting port are offset from each other in the depthwise and widthwise directions in such a manner that the gaseous and liquid refrigerant communication pipes connected to the connecting ports do not interfere with each other when they are drawn out in the depthwise direction with their widthwise positions maintained constant and their height positions arranged such that they overlap partially in a side view. Furthermore, the first connecting port and second connecting port are offset from each other in the depthwise and widthwise directions in such a manner that the gaseous and liquid refrigerant communication pipes connected to the connecting ports do not interfere with each other even when they are drawn out in the widthwise direction with their depthwise positions maintained constant and their height positions arranged such that they overlap partially in a side view.

Since the first connecting port and second connecting port are offset from each other in the depthwise and widthwise directions, work associated with bending the pipes and using pipe joints in order to avoid interference between the refrigerant communication pipes can be held to a minimum.

Also, by drawing the pipes out in the widthwise direction or the depthwise direction in such a manner that the centers of the refrigerant communication pipes are slightly offset from each other in the height direction and a portion of the pipes overlap in a plan view and a side view, the pipe layout can be made more compact (occupy less space) in the height direction and in the widthwise or depthwise direction. This kind of arrangement is particular effective when the two refrigerant communication pipes have different pipe diameters.

According to a fourth aspect of the present invention, the outdoor air conditioner unit of the first or second aspects of the present invention is provided, wherein the first connecting port and second connecting port are offset from each other in the depthwise and widthwise directions in such a manner that the gaseous and liquid refrigerant communication pipes connected to the connecting ports do not interfere with each other even when they are drawn out in the depthwise direction with their widthwise positions maintained constant and their height positions the same. Furthermore, the first connecting port and second connecting port are offset from each other in the depthwise and widthwise directions in such a manner that the gaseous and liquid refrigerant communication pipes connected to the connecting ports do not interfere with each other even when they are drawn out in the widthwise direction with their depthwise positions maintained constant and their height positions the same.

Since the first connecting port and second connecting port are amply offset from each other in the depthwise and widthwise directions, work associated with bending the pipes and using pipe joints in order to avoid interference between the refrigerant communication pipes can be held to a minimum.

According to a fifth aspect of the present invention, the outdoor air conditioner unit of any one of the first to fourth aspects of the present invention is provided, wherein the first connecting port and the second connecting port are offset by approximately the same distance in both the depthwise direction and the widthwise direction.

Since the first connecting port and second connecting port are offset by approximately the same distance in the depthwise direction as in the widthwise direction, interference between refrigerant communication pipes drawn out in the depthwise or widthwise direction can be suppressed while reducing the relative distance between the first connecting port and the second connecting port and reducing the space occupied by the gas-side shut-off valve and the liquid-side shut-off valve.

Furthermore, since the first connecting port and second connecting port are offset by approximately the same distance in the depthwise and widthwise directions, in a plan view a straight line joining the centers of the two connecting ports is oriented at approximately a 45-degree angle with respect to the panel oriented in the depthwise direction and the panel oriented in the widthwise direction.

According to a sixth aspects of the present invention, the outdoor air conditioner unit of any one of the first to fifth aspects of the present invention is provided, wherein the first connecting port and the second connecting port face both face downward. An air conditioner outdoor unit in accordance with claim 6 is also provided with a box-shaped casing and bottom-raising members. The casing covers the gas-side shut-off valve and the liquid-side shut-off valve, and the casing has an opening below the gas-side shut-off valve and the liquid-side shut-off valve. The bottom-raising members serve to secure space between the surface on which the outdoor unit is to be installed and the bottom panel of the casing.

By directing the first connecting port and second connecting port downward and providing bottom-raising members so as to open a space between the surface on which the outdoor unit is being installed and the bottom panel of the casing, this claim makes it easier to improve the external appearance of the outdoor unit by passing the refrigerant communication pipes in the space under the casing.

BRIEF DESCRIPTION OF THE DRAWINGS

FIG. 7(*a*) is a frontal view of a conventional outdoor unit.

FIG. 7(*b*) is a view as indicated by the arrows b—b in FIG. 7(*a*).

PREFERRED EMBODIMENTS OF THE INVENTION

<Constituent Features of the Air Conditioning System>

Figure 1:
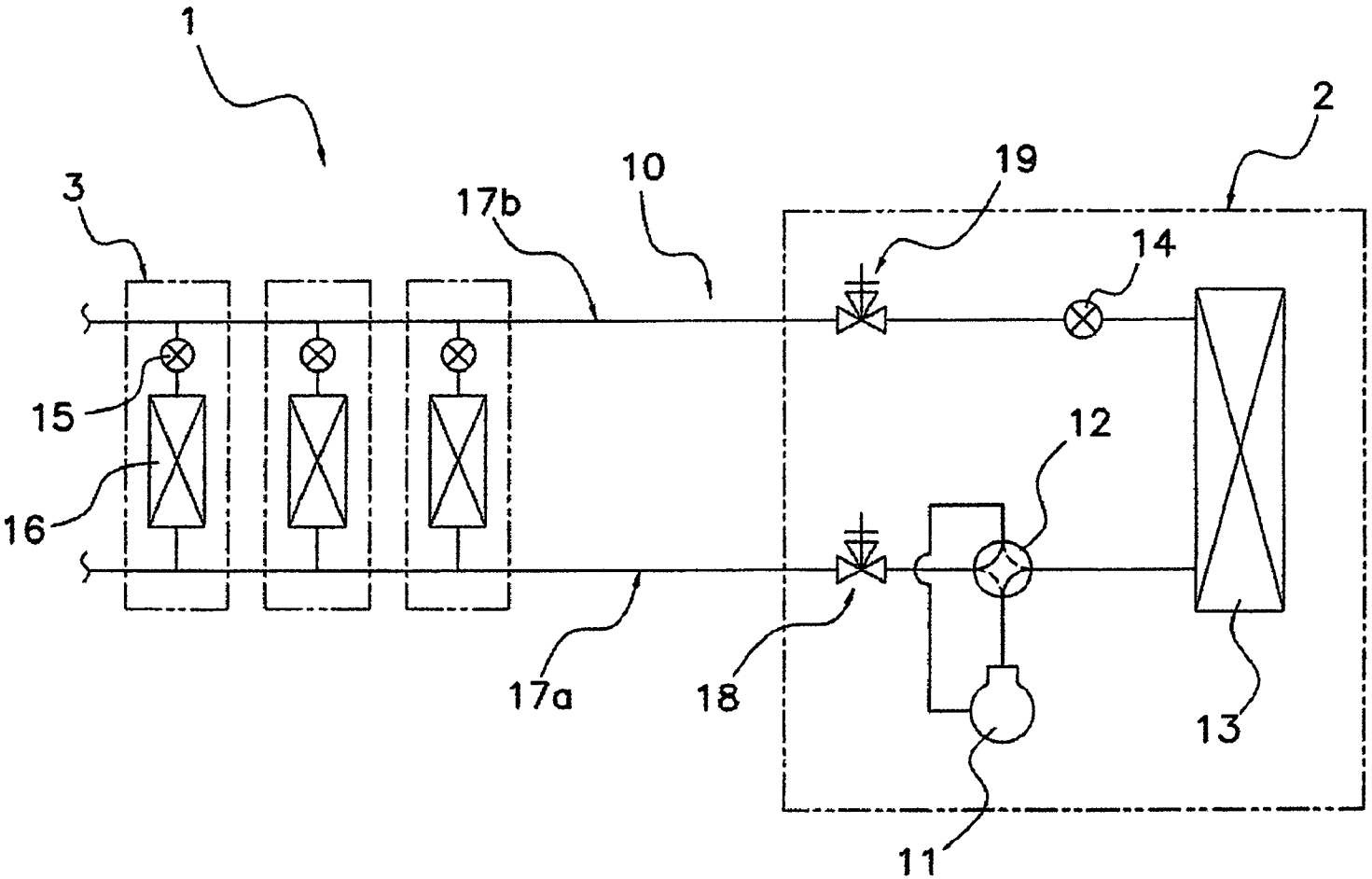
FIG. 1 is a refrigerant circuit diagram of an air conditioning system that includes an outdoor unit.

FIG. 1 shows the refrigerant circuit of an air conditioning system that includes an outdoor air conditioner unit in accordance with an embodiment of the present invention. The air conditioning system 1 is a multiple-type air conditioning system for office buildings having one outdoor unit 2 and a plurality of indoor units 3 connected in parallel. The refrigerant circuit 10 of the air conditioning system 1 includes a compressor 11, a four-way selector valve 12, an outdoor heat exchanger 13, an outdoor expansion valve 14, indoor expansion valves 15, and the indoor heat exchangers 16 connected in sequence and is configured to perform a vapor compression type refrigeration cycle. The compressor 11, four-way selector valve 12, outdoor heat exchanger 13, and outdoor expansion valve 14 are contained in the outdoor unit 2 and the indoor expansion valves 15 and indoor heat exchangers 16 are contained in the indoor units 3. The four-way selector valve 12 and the indoor heat exchangers 16 are connected by a gaseous refrigerant communication pipe 17*a* and the outdoor expansion valve 14 and the indoor expansion valves 15 are connected by a liquid refrigerant communication pipe 17*b*. The refrigerant communication pipes 17*a*, 17*b* are arranged between the outdoor unit 2 and the indoor unit 3.

The refrigerant circuit of the air conditioning system shown in FIG. 1 is a simplification of the actual circuit. For example, the actual compressor 11 used is often a combination of a variable capacity compressor whose rotational speed can be controlled with an inverter and a fixed capacity compressor that is controlled in an on-off manner (see FIG. 3). Additionally, a receiver, an accumulator, and other associated devices (not shown in the figures) are provided inside the outdoor unit 2. The terminal portions of the refrigerant circuit inside the outdoor unit are provided with a gas-side shut-off valve 18 and a liquid-side shut-off valve 19. The gas-side shut-off valve 18 is arranged on the side where the four-way selector valve 12 is located and the liquid-side shut-off valve 19 is arranged on the side where the outdoor expansion valve 14 is located. The gas-side shut-off valve 18 is connected to the gaseous refrigerant communication pipe 17*a* and the liquid-side shut-off valve 19 is connected to the liquid refrigerant communication pipe 17*b*. The shut-off valves 18, 19 are in the closed state when the outdoor unit 2 and indoor units 3 are installed. The shut-off valves 18, 19 are then opened after the units 2, 3 are installed onsite and the gaseous refrigerant communication pipe 17*a* and the liquid refrigerant pipe communication 17*b* are connected to the shut-off valves 18, 19.

<Operation of the Air Conditioning System>

The operation of the air conditioning system will now be described.

First, when the system is operated in cooling mode, the four-way selector valve 12 is held in the state indicated by the solid lines in FIG. 1. High-temperature, high-pressure gaseous refrigerant discharged from the compressor 11 passes through the four-way selector valve 12 and into the outdoor heat exchanger 13, where it is condensed and changed to a liquid by exchanging heat with the outdoor air. The liquefied refrigerant passes through the fully open outdoor expansion valve 14 and flows into the indoor units 3 via the liquid refrigerant communication pipe 17*b*. At the indoor units 3, the refrigerant is pressure-reduced by the indoor expansion valve 15 to a prescribed low pressure and evaporated in the indoor heat exchanger 16 by exchanging heat with the indoor air. Indoor air cooled by the evaporation of the refrigerant is blown into the indoor area (e.g., room or rooms) by an indoor fan (not shown) so as to cool the indoor area. After being evaporated in the indoor heat exchanger 16, the gaseous refrigerant returns to the outdoor unit 2 through the gaseous refrigerant communication pipe 17*a* and is drawn into the compressor 11.

Meanwhile, when the system is operated in heating mode, the four-way selector valve 12 is held in the state indicated by the broken lines in FIG. 1. High-temperature, high-pressure gaseous refrigerant discharged from the compressor 11 passes through the four-way selector valve 12 and into the indoor heat exchangers 16 of the indoor units 3, where it is condensed and changed to a liquid by exchanging heat with the indoor air. Indoor air heated by the condensation of the refrigerant is blown into the indoor area (e.g., room or rooms) by an indoor fan so as to heat the indoor area. The refrigerant liquefied in the indoor heat exchangers 16 passes through the fully open indoor expansion valves 15 and returns to the outdoor unit 2 via the liquid refrigerant communication pipe 17*b*. At the outdoor unit 2, the refrigerant is pressure-reduced by the outdoor expansion valve 14 to a prescribed low pressure and evaporated in the outdoor heat exchanger 13 by exchanging heat with the outdoor air. After being evaporated in the outdoor heat exchanger 13, the gaseous refrigerant passes through the four-way selector valve 12 and is drawn into the compressor 11.

During both cooling mode and heating mode, the indoor expansion valves 15 of indoor units 3 that are stopped are closed and the refrigerant is not sent to the indoor heat exchangers 16 of those indoor units 3.

<Constituent Features of the Outdoor Unit>

Figure 2:
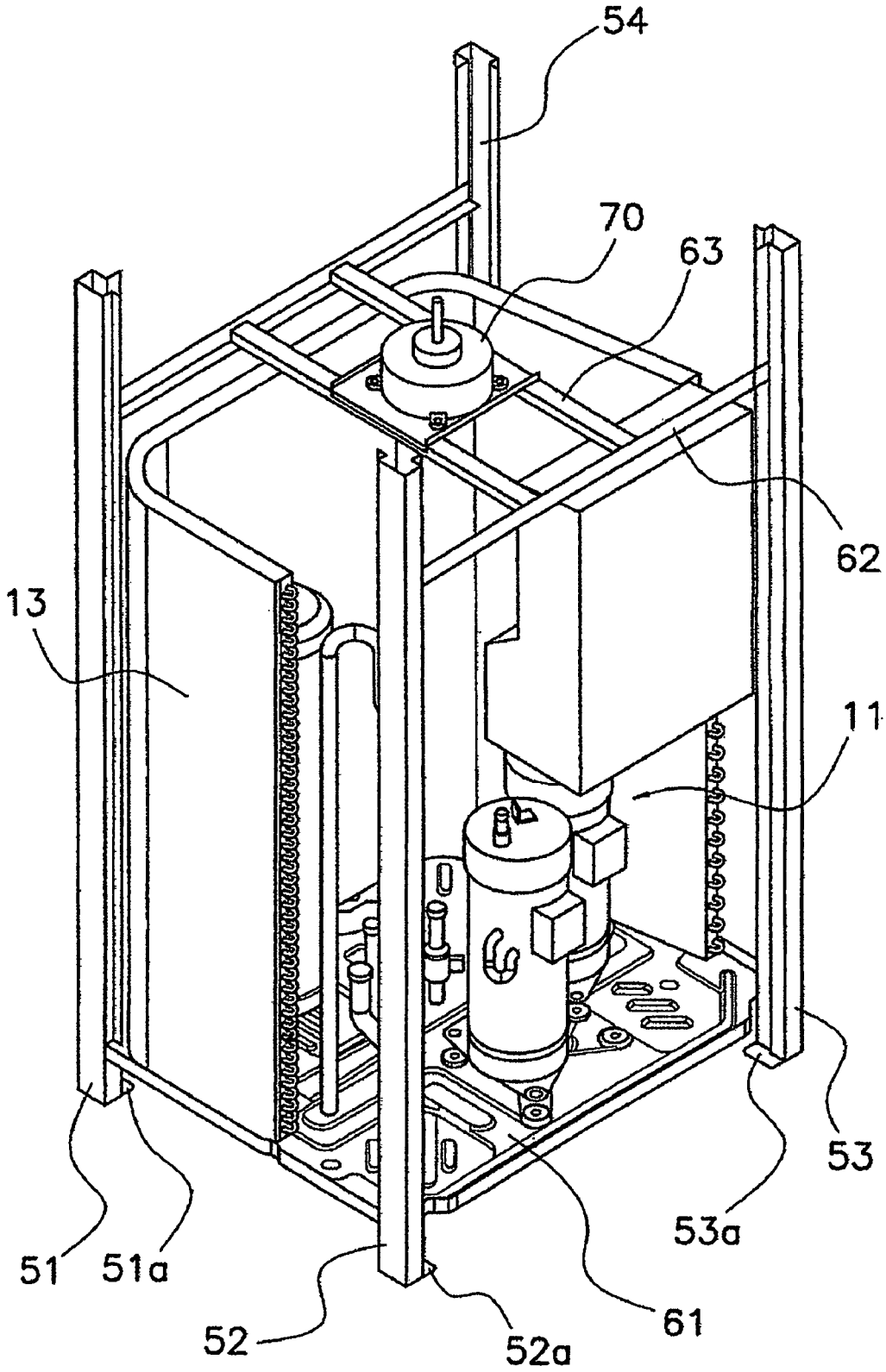
FIG. 2 is a perspective view of the outdoor unit excluding the casing.
Figure 3:
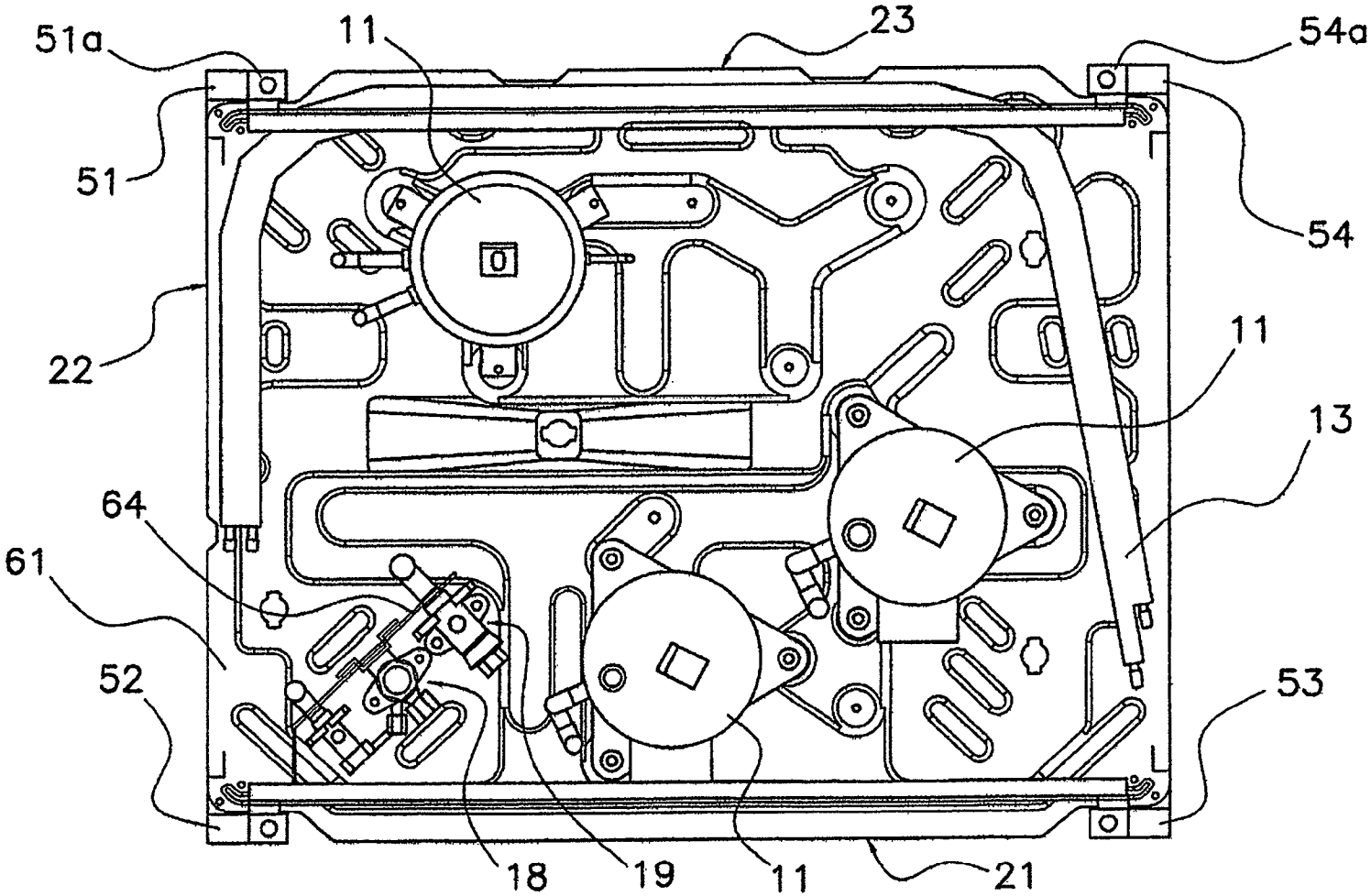
FIG. 3 is a top plan view of the inside of the outdoor unit.

The outdoor unit 2 will now be described in detail with reference to FIGS. 2 and 3. FIG. 2 is a perspective view of the outdoor unit 2 with the casing and outdoor fan removed. FIG. 3 is a plan view looking downward from a position approximately midway along the height of the outdoor unit. In FIG. 2, the shut-off valves 18, 19 are omitted. The internal refrigerant piping is also omitted from the figure.

As shown in FIG. 3, the front panel 21, side panel 22, and rear panel 23 of the casing are mounted to the outside of support columns 51, 52, 53, 54. The four vertical support columns 51 to 54 are fastened together by the bottom frame 61 located near the bottom end, the horizontal stays 62 and the motor support rack 63 located at a top portion. A motor 70 for driving the outdoor fan (not shown) is mounted to the motor support rack 63.

The support columns 51 to 54 extend downward beyond the bottom frame 61. Thus, a space is formed between the bottom frame 61 and the installation surface (floor surface) after the outdoor unit has been mounted to the installation surface. This space is large enough (high enough) to pass the gaseous refrigerant communication pipe 17*a* and the liquid refrigerant communication pipe 17*b*. A portion of the bottom end of each support column 51 to 54 is bent inward so as to form a rectangular base foot 51*a*, 52*a*, 53*a*, 54*a*. Each base foot 51*a*, 52*a*, 53*a*, 54*a* is provided with a through hole for inserting a chemical anchor or the like to secure the outdoor unit 2 to the installation surface.

The bottom frame 61 supports the compressor 11 and the outdoor heat exchanger 13 and also serves to secure the shut-off valves 18, 19 through a mounting plate 64. The bottom frame 61 has an opening in the portion thereof below the shut-off valves 18, 19.

<Arrangement of the Shut-Off Valves in the Outdoor Unit>

Figure 4:
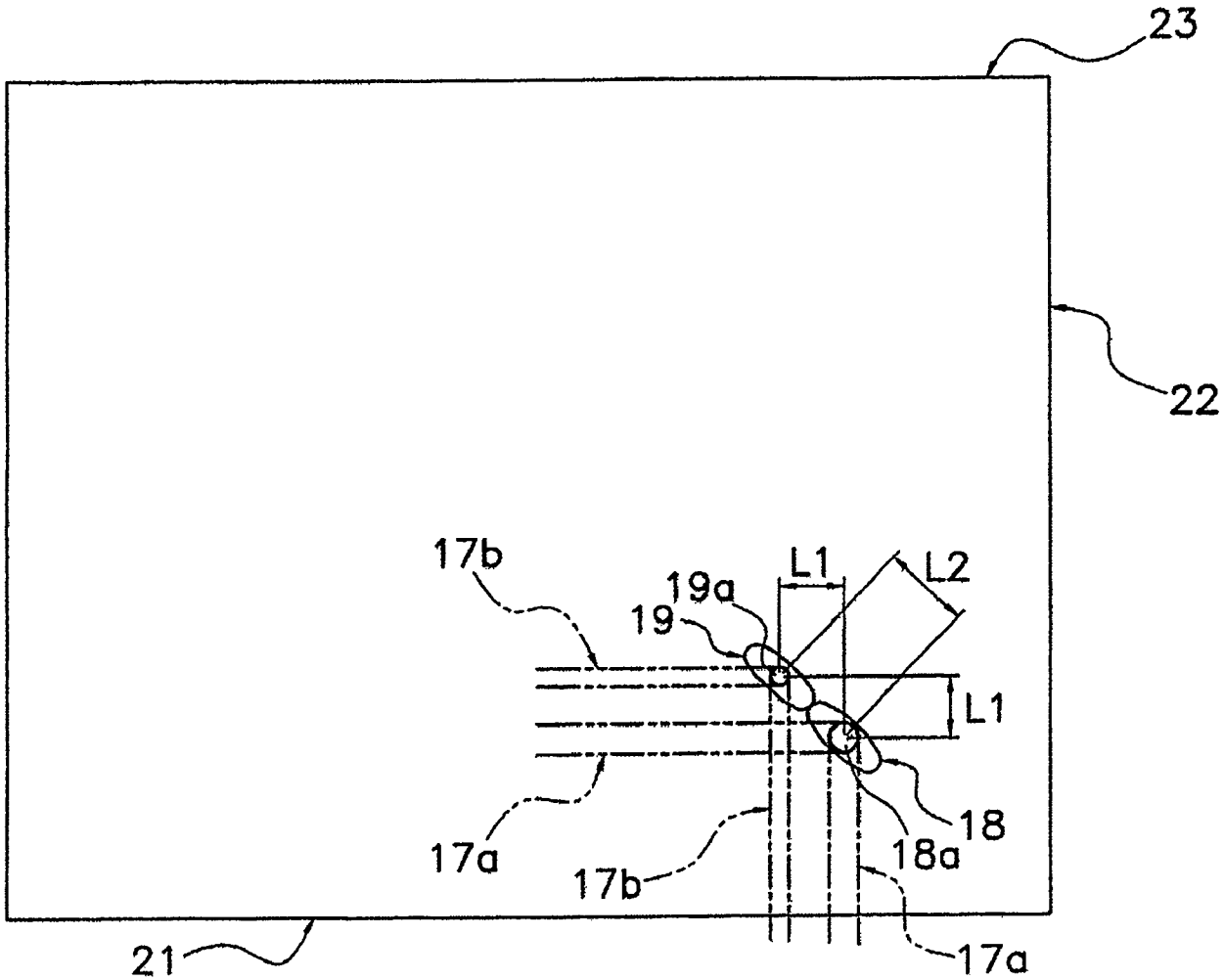
FIG. 4 is a diagram illustrating the arrangement of the gas-side shut-off valve and the liquid-side shut-off valve of the outdoor unit.

The gas-side shut-off valve 18 and the liquid-side shut-off valve 19 of the outdoor unit 2 are arranged closely adjacent to each other as shown in FIGS. 3 and 4. The gas-side shut-off valve 18 and the liquid-side shut-off valve 19 are aligned in a direction forming an angle of approximately 45 degrees with respect to the front panel 21 and the side panel 22 of the casing. Thus, the gas-side shut-off valve 18 and the liquid-side shut-off valve 19 are separated by a distance of L2 and are offset from each other by a distance of L1 in the widthwise direction (horizontal direction parallel to the front panel 21) and also by a distance of L1 in the depthwise direction (horizontal direction parallel to the side panel 22). The distance L2 is approximately 1.4 times the distance L1.

The pipe connecting port 18*a* of the gas-side shut-off valve 18 and the pipe connecting port 19*a* of the liquid-side shut-off valve 19 both face in the same downward direction. Although the shut-off valves 18, 19 are shown with simplified structures in the figures, the shut-off valves 18, 19 are constructed to connect to the refrigerant communication pipes 17*a*, 17*b* with a flare nut (or a flange).

By arranging the shut-off valves 18, 19 as just described, the gaseous and liquid refrigerant communication pipes 17*a*, 17*b* connected to the connecting ports 18*a*, 19*a* do not interfere with each other even when they are drawn out in the forward direction with their widthwise positions maintained constant and their height positions (e.g., a position between the installation surface and the bottom frame 61) the same (the double-dot chain lines shown in FIG. 4 indicate the pipes 17*a*, 17*b*). Likewise, the gaseous and liquid refrigerant communication pipes 17*a*, 17*b* connected to the connecting ports 18*a*, 19*a* do not interfere with each other even when they are drawn out in a sideways direction with their depthwise positions maintained constant and their height positions the same (the double-dot chain lines shown in FIG. 4 indicate the pipes 17*a*, 17*b*).

Although in the outdoor unit 2 of this embodiment the gas-side shut-off valve 18 and the liquid-side shut-off valve 19 are arranged as shown in FIGS. 3 and 4, it is also acceptable for the positions of the gas-side shut-off valve 18 and the liquid-side shut-off valve 19 to be reversed.

<Characteristic Features of an Outdoor Air Conditioner Unit in Accordance with This Embodiment (1)

In conventional outdoor units, the pipe connecting port of the gas-side shut-off valve and the pipe connecting port of the liquid-side shut-off valve are aligned in either the depthwise direction along the side panel of the casing or the widthwise direction along the front panel of the casing. Consequently, when the connecting ports are aligned in the depthwise direction, the refrigerant communication pipes will interfere with each other if they are drawn out in the depthwise direction at the same height from the connecting ports. Meanwhile, when the connecting ports are aligned in the widthwise direction, the refrigerant communication pipes will interfere with each other if they are drawn out in the widthwise direction at the same height from the connecting ports.

Conversely, in an outdoor unit 2 in accordance with this embodiment, the pipe connecting port 18*a* of the gas-side shut-off valve 18 and the pipe connecting port 19*a* of the liquid-side shut-off valve 19 are offset from each other by a distance L1 in both the depthwise direction and the widthwise direction in a plan view. Likewise, the gaseous and liquid refrigerant communication pipes 17*a*, 17*b* do not interfere with each other even when they are drawn out from the connecting ports 18*a*, 19*a* in a depthwise direction or a widthwise direction in such a manner that their height positions underneath the bottom frame 61 are the same. As a result, work associated with bending the refrigerant communication pipes 17*a*, 17*b* and using pipe joints can be held to a minimum.

(2)

In an outdoor unit 2 in accordance with this embodiment, the pipe connecting port 18*a* of the gas-side shut-off valve 18 and the pipe connecting port 19*a* of the liquid-side shut-off valve 19 are offset from each other by the same distance L1 in both the depthwise direction and the widthwise direction. As a result, the relative distance L2 between the connecting ports 18*a*, 19*a* can be reduced and the space occupied by the gas-side shut-off valve 18 and the liquid-side shut-off valve 19 inside the casing can be reduced.

Moreover, the work space is the same as in conventional outdoor units because the actual relative distance L2 between the shut-off valves is no smaller than in conventional outdoor units in which the shut-off valves are arranged in the depthwise direction or the widthwise direction; that is, when viewed diagonally the distance between the shut-off valves 18, 19 is the same as in conventional outdoor units.

(3)

In an outdoor unit 2 in accordance with this embodiment, the pipe connecting port 18*a* of the gas-side shut-off valve 18 and the pipe connecting port 19*a* of the liquid-side shut-off valve 19 both face downward in the same manner. As a result, it is easier to apply thermally insulating tape to both refrigerant communication pipes 17*a*, 17*b* at the same time and to cover them with a decorative metal plate.

(4)

In an outdoor unit 2 in accordance with this embodiment, the pipe connecting port 18*a* of the gas-side shut-off valve 18 and the pipe connecting port 19*a* of the liquid-side shut-off valve 19 both face downward and portions of the support columns 51 to 54 extend downward beyond the bottom frame 61 such that a space is formed between the bottom frame 61 and the surface on which the outdoor unit 2 is installed. As a result, the refrigerant communication pipes 17*a*, 17*b* can be passed through the space and the external appearance of the outdoor unit can be improved.

Other Embodiments

In the previously described embodiment, the gas-side shut-off valve 18 and the liquid-side shut-off valve 19 are arranged so as to be oriented at a 45-degree angle with respect to both the front panel 21 and the side panel 22 of the casing. As a result, even when the gaseous and liquid refrigerant communication pipes 17*a*, 17*b* connected to the connecting ports 18*a*, 19*a* are drawn out in the forward direction or a sideways direction in such a manner that their widthwise positions are maintained constant and their height positions are the same, the gaseous and liquid refrigerant pipes 17*a*, 17*b* do not interfere with each other because they are separated from each other in a plan view.

Figure 5:
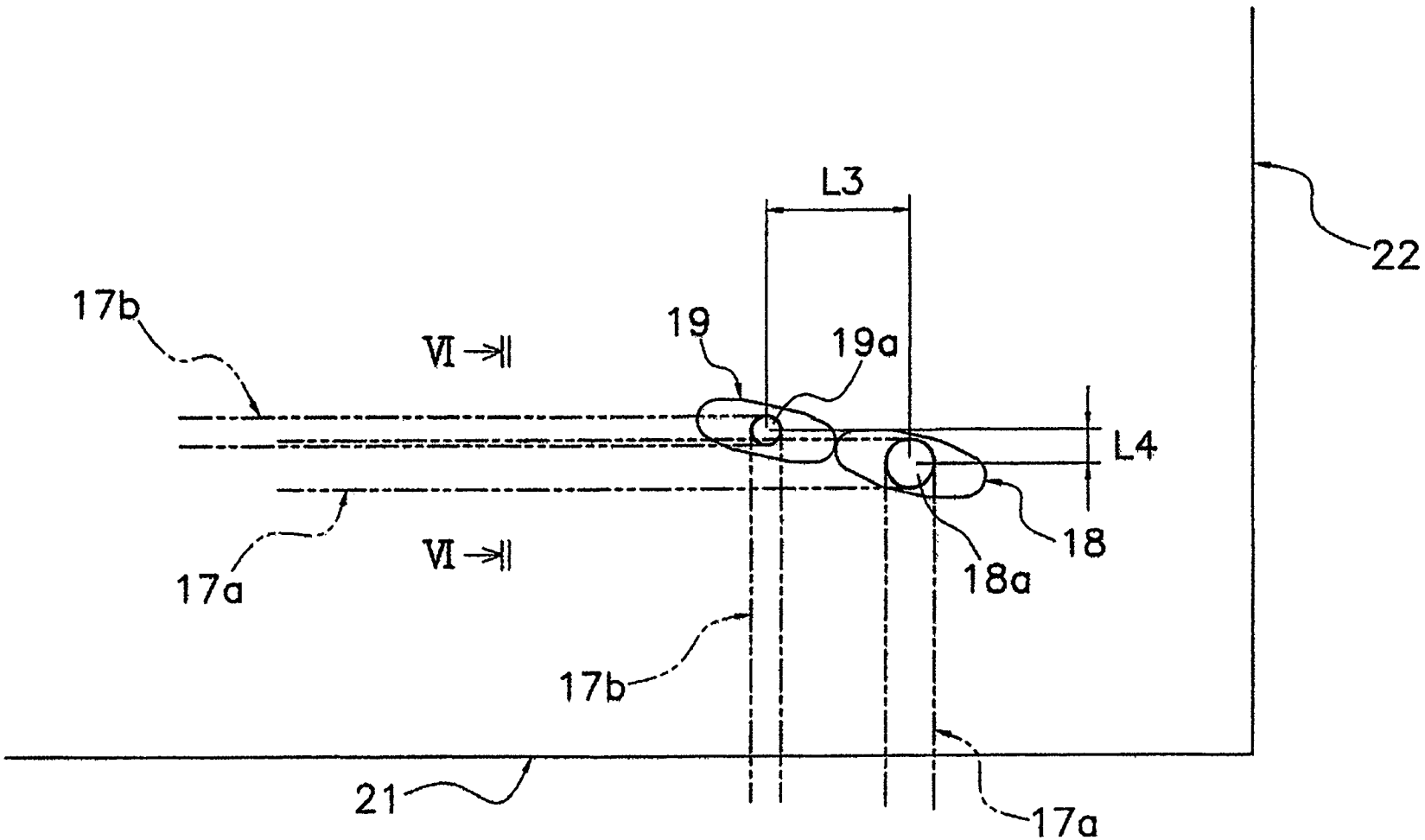
FIG. 5 is a diagram illustrating arrangement of the gas-side shut-off valve and the liquid-side shut-off valve of the outdoor unit in another embodiment.

Instead arranging the shut-off valves 18, 19 as shown in FIG. 4, however, it is also possible to arrange the shut-off valves 18, 19 as shown in FIG. 5.

In the arrangement of the shut-off valves 18, 19 shown in FIG. 5, the gas-side shut-off valve 18 and the liquid-side shut-off valve 19 are offset from each other by a distance L3 in the widthwise direction (horizontal direction parallel to the front panel 21) and a distance L4 in the depthwise direction (horizontal direction parallel to the side panel 22). The distance L3 is set such that when the pipes 17*a*, 17*b* are drawn out in the forward direction without bending the pipes to the left or right, the pipes 17*a*, 17*b* will be separated from each other and not overlap in a plan view. The distance L4 is set to a comparatively small distance such that when the pipes 17*a*, 17*b* are drawn out in a sideways direction without bending the pipes to the forward or rearward, the pipes 17*a*, 17*b* will partially overlap in a plan view.

Figure 6:
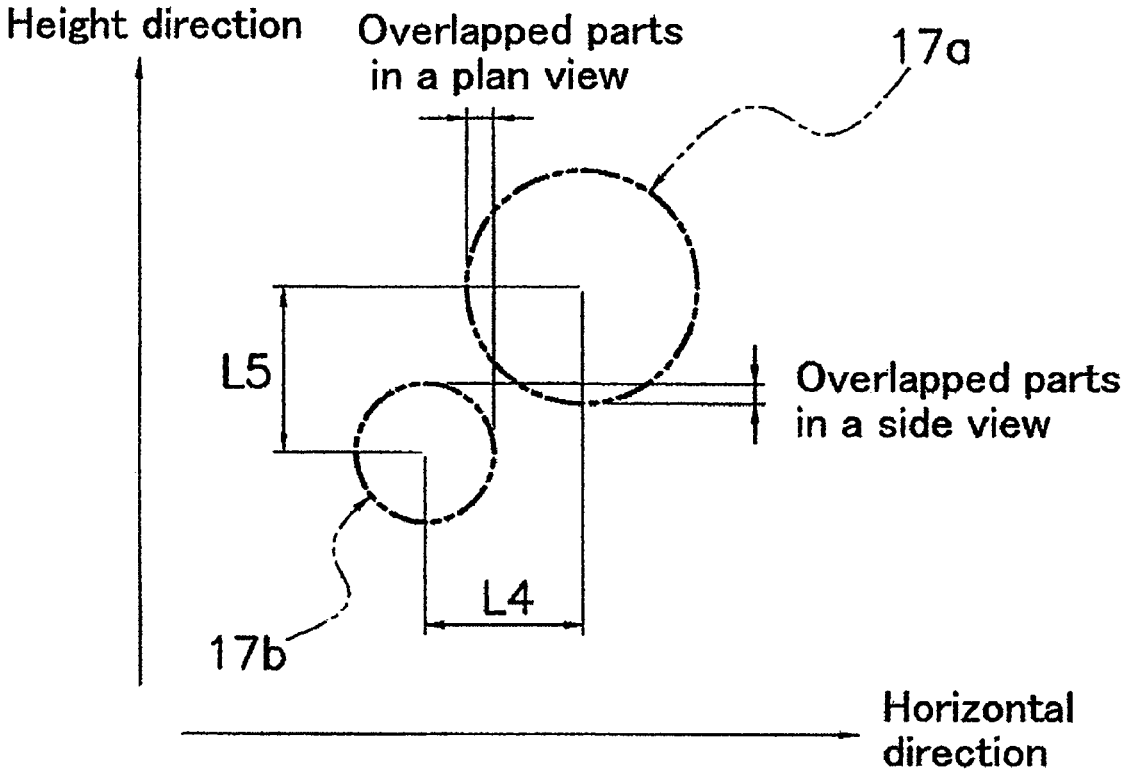
FIG. 6 is a cross sectional view as indicated by the arrows VI—VI in FIG. 5.

Therefore, here, as shown in FIG. 6, when the gaseous and liquid refrigerant pipes 17*a*, 17*b* are drawn out sideways from the shut-off valves 18, 19 without bending them forward or rearward, the centers of the pipes 17*a*, 17*b* are offset from each other in the height direction by a distance L5 and the pipes 17*a*, 17*b* are drawn out sideways in such a manner that they partially overlap in a plan view. As a result, the pipes 17*a*, 17*b* can be drawn out in a sideways direction from the shut-off valves 18, 19 without bending the pipes 17*a*, 17*b* or using pipe joints and the horizontal space occupied by the pipes 17*a*, 17*b* can be reduced. Meanwhile, although the centers of the pipes 17*a*, 17*b* are offset slightly (distance L5) in the height direction, as shown in FIG. 6, the pipes 17*a*, 17*b* are only partially overlapped in a side view and the heights of the pipes 17*a*, 17*b* can be set to be substantially the same. Consequently, the space occupied by the pipes 17*a*, 17*b* in the height direction is reduced and the pipes 17*a*, 17*b* can be passed through the gap between the bottom frame and the installation surface of the outdoor unit, even when said gap is small.

APPLICABILITY TO INDUSTRY

In an outdoor air conditioner unit in accordance with the present invention, the first connecting port and the second connecting port are offset from each other in both the depthwise direction and the widthwise direction of the outdoor unit in a plan view. The connecting ports are offset by a sufficient amount that the refrigerant communication pipes do not interfere with each other in a plan view when they are drawn out from the connecting ports in the depthwise direction or in the widthwise direction. Thus, when an outdoor air conditioner unit in accordance with the present invention is used, the refrigerant communication pipes will not interfere with each other in cases where the refrigerant communication pipes are drawn out from the connecting ports in the depthwise direction at the same height or in cases where the refrigerant communication pipes are drawn out from the connecting ports in the widthwise direction at the same height.

What is claimed is:

1. An outdoor air conditioner unit configured to be connected to an indoor unit by a gaseous refrigerant communication pipe and a liquid refrigerant communication pipe, the outdoor air conditioner unit comprising:

a gas-side shut-off valve having a first connecting port configured to be connected to the gaseous refrigerant communication pipe; and a liquid-side shut-off valve having a second connecting port configured to be connected to the liquid refrigerant communication pipe;

the first and second connecting ports being configured and arranged as view in a plan view such that the first and second connecting ports are offset from each other in both depthwise direction and widthwise direction.

2. The outdoor air conditioner unit as recited in claim 1, wherein the first and second connecting ports both face in a first direction.

3. The outdoor air conditioner unit as recited in claim 1, wherein the first and second connecting ports are offset from each other in the depthwise and widthwise directions such that:

the gaseous and liquid refrigerant communication pipes connected to the first and second connecting ports do not interfere with each other even when drawn out in the depthwise direction while maintaining widthwise positions of the gaseous and liquid refrigerant communication pipes constant and height positions of the gaseous and liquid refrigerant communication pipes being arranged such that the gaseous and liquid refrigerant communication pipes overlap partially in a side elevational view; and the gaseous and liquid refrigerant communication pipes connected to the first and second connecting ports do not interfere with each other even when drawn out in the widthwise direction while maintaining constant depthwise positions of the gaseous and liquid refrigerant communication pipes constant and the height positions of the gaseous and liquid refrigerant communication pipes being arranged such that the gaseous and liquid refrigerant communication pipes overlap partially in a side elevational view.

4. The outdoor air conditioner unit as recited in claim 1, wherein the first and second connecting ports are offset from each other in the depthwise and the widthwise directions such that:

the gaseous and liquid refrigerant communication pipes connected to the first and second connecting ports do not interfere with each other even when drawn out in the depthwise direction while maintaining widthwise positions of the gaseous and liquid refrigerant communication pipes constant and height positions of the gaseous and liquid refrigerant communication pipes being the same; and the gaseous and liquid refrigerant communication pipes connected to the first and second connecting ports do not interfere with each other even when drawn out in the widthwise direction while maintaining depthwise positions of the gaseous and liquid refrigerant communication pipes constant and height positions of the gaseous and liquid refrigerant communication pipes being the same.

5. The outdoor air conditioner unit as recited in claim 1, wherein the first and second connecting ports are offset by approximately the same distance in both the depthwise direction and the widthwise direction.

6. The outdoor air conditioner unit as recited in claim 1, further comprising a box-shaped casing covering the gas-side shut-off valve and the liquid-side shut-off valve and having an opening below the gas-side shut-off valve and the liquid-side shut-off valve; and a plurality of bottom-raising members serving to maintain a space between a surface on which the outdoor unit is to be installed and a bottom panel of the casing, the first and second connecting ports face downward.

7. The outdoor air conditioner unit as recited in claim 2, wherein the first and second connecting ports are offset from each other in the depthwise and widthwise directions such that:

the gaseous and liquid refrigerant communication pipes connected to the first and second connecting ports do not interfere with each other even when drawn out in the depthwise direction while maintaining widthwise positions of the gaseous and liquid refrigerant communication pipes constant and height positions of the gaseous and liquid refrigerant communication pipes being arranged such that the gaseous and liquid refrigerant communication pipes overlap partially in a side elevational view; and the gaseous and liquid refrigerant communication pipes connected to the first and second connecting ports do not interfere with each other even when drawn out in the widthwise direction while maintaining constant depthwise positions of the gaseous and liquid refrigerant communication pipes constant and the height positions of the gaseous and liquid refrigerant communication pipes being arranged such that the gaseous and liquid refrigerant communication pipes overlap partially in a side elevational view.

8. The outdoor air conditioner unit as recited in claim 2, wherein the first and second connecting ports are offset from each other in the depthwise and the widthwise directions such that:

the gaseous and liquid refrigerant communication pipes connected to the first and second connecting ports do not interfere with each other even when drawn out in the depthwise direction while maintaining widthwise positions of the gaseous and liquid refrigerant communication pipes constant and height positions of the gaseous and liquid refrigerant communication pipes being the same; and the gaseous and liquid refrigerant communication pipes connected to the first and second connecting ports do not interfere with each other even when drawn out in the widthwise direction while maintaining depthwise positions of the gaseous and liquid refrigerant communication pipes constant and height positions of the gaseous and liquid refrigerant communication pipes being the same.

9. The outdoor air conditioner unit as recited in claim 2, wherein the first and second connecting ports are offset by approximately the same distance in both the depthwise direction and the widthwise direction.

10. The outdoor air conditioner as recited in claim 2, further comprising a box-shaped casing covering the gas-side shut-off valve and the liquid-side shut-off valve and having an opening below the gas-side shut-off valve and the liquid-side shut-off valve; and a plurality of bottom-raising members serving to maintain a space between a surface on which the outdoor unit is to be installed and a bottom panel of the casing, the first and second connecting ports face downward.

11. The outdoor air conditioner unit as recited in claim 3, wherein the first and second connecting ports are offset by approximately the same distance in both the depthwise direction and the widthwise direction.

12. The outdoor air conditioner as recited in claim 3, further comprising a box-shaped casing covering the gas-side shut-off valve and the liquid-side shut-off valve and having an opening below the gas-side shut-off valve and the liquid-side shut-off valve; and a plurality of bottom-raising members serving to maintain a space between a surface on which the outdoor unit is to be installed and a bottom panel of the casing, the first and second connecting ports face downward.

13. The outdoor air conditioner unit as recited in claim 4, wherein the first and second connecting ports are offset by approximately the same distance in both the depthwise direction and the widthwise direction.

14. The outdoor air conditioner as recited in claim 4, further comprising a box-shaped casing covering the gas-side shut-off valve and the liquid-side shut-off valve and having an opening below the gas-side shut-off valve and the liquid-side shut-off valve; and a plurality of bottom-raising members serving to maintain a space between a surface on which the outdoor unit is to be installed and a bottom panel of the casing, the first and second connecting ports face downward.

15. The outdoor air conditioner as recited in claim 5, further comprising a box-shaped casing covering the gas-side shut-off valve and the liquid-side shut-off valve and having an opening below the gas-side shut-off valve and the liquid-side shut-off valve; and a plurality of bottom-raising members serving to maintain a space between a surface on which the outdoor unit is to be installed and a bottom panel of the casing, the first and second connecting ports face downward.

* * * * *

UNITED STATES PATENT AND TRADEMARK OFFICE

CERTIFICATE OF CORRECTION

PATENT NO. : 7,086,250 B2
APPLICATION NO. : 10/493862
DATED : August 8, 2006
INVENTOR(S) : Ishihara et al.

It is certified that error appears in the above-identified patent and that said Letters Patent is hereby corrected as shown below:

On the Title page change the listing of Item [75] Inventors from

"[75] Inventors: Hiroki Ishihara, Sakai (JP);
Hiromune Matsuoka, Sakai (JP);
Toshiaki Mukaidani, Sakai (JP);
Tadashi Saoi, Sakai (JP)"

to

-- [75] Inventors: Hiroki Ishihara, Sakai (JP);
Hiromune Matsuoka, Sakai (JP);
Toshiaki Mukaidani, Sakai (JP);
Tadashi Sao, Sakai (JP) --

Signed and Sealed this

Second Day of January, 2007

JON W. DUDAS
*Director of the United States Patent and Trademark Office*